United States Patent [19]

Bachmann et al.

[11] Patent Number: 4,711,611

[45] Date of Patent: Dec. 8, 1987

[54] METHOD AND APPARATUS FOR FABRICATING A CAN BODY

[75] Inventors: Henry C. Bachmann; Ermal C. Fraze, both of Dayton, Ohio

[73] Assignee: Dayton Reliable Tool & Mfg. Co., Dayton, Ohio

[21] Appl. No.: 889,054

[22] Filed: Jul. 23, 1986

[51] Int. Cl.[4] ..... B21D 51/28

[52] U.S. Cl. ..... 413/69; 72/336; 72/347; 72/349; 72/379

[58] Field of Search ..... 413/69; 72/343, 347, 72/348, 379, 329, 336, 349

[56] References Cited

U.S. PATENT DOCUMENTS

| | | | |
|---|---|---|---|
| 3,593,552 | 7/1971 | Fraze | 72/347 |
| 3,704,618 | 12/1972 | Cvacho et al. | 72/336 |
| 3,998,174 | 12/1976 | Saunders | 72/349 |
| 4,005,665 | 2/1977 | Nishihara et al. | 72/379 |
| 4,030,432 | 6/1977 | Miller et al. | 413/69 |
| 4,040,282 | 8/1977 | Saunders | 72/349 |
| 4,425,778 | 1/1984 | Franek et al. | 72/347 |
| 4,446,714 | 5/1984 | Cvacho | 72/348 |

*Primary Examiner*—Frederick R. Schmidt
*Assistant Examiner*—Robert Showalter
*Attorney, Agent, or Firm*—Biebel, French & Nauman

[57] ABSTRACT

Methods and apparatus are disclosed for fabricating from ductile sheet metal a can body with integral side and bottom walls. A rounded non-circular blank is formed from the sheet metal, the blank having a greater width across the grain of the metal than along such grain. The blank is formed into a cup-shaped receptacle having a bottom and an upstanding wall of not less than the desired internal size of the can body. The wall has a length substantially less than the desired depth of the can body and is substantially thicker than the thickness desired in the finished can body. The wall is then thinned to the desired thickness so as to lengthen the wall to at least the desired depth of the can body.

16 Claims, 8 Drawing Figures

METHOD AND APPARATUS FOR FABRICATING A CAN BODY

BACKGROUND OF THE INVENTION

The present invention relates to a method and apparatus for the formation of can bodies. Various types of ductile metal cans are used to provide packaging for a wide variety of foods, beverages and others products, the package being hermetically sealed and possibly under natural or created pressure conditions, or under vacuum. One popular can, offered in different sizes, is the so-called beer/beverage can having a unitary drawn can body to which an easy-opening end is attached after filling. Other cans, often of the wide-mouth type, are used to package cheese spreads, nuts, and other food products which may be only hermetically sealed, or may be vacuum packed in some instances or packed with an inert gas under pressure in other instances. In aggregate, the market demand for all these various types of unit-body cans amounts to billions of units.

By way of a striking example, those cans used for containing beer and soft drinks are required to withstand internal pressure, rough handling, and substantial temperature differences, yet maintain a complete hermetic seal to protect the contents of the can. Cans of this type alone are used in very large volume, billions of cans per year, and at present the metals most used for fabricating such cans are aluminum and thin coated steel due to their comparative inexpensiveness and workability.

The typical modern can consists of a unitary deep drawn body that includes both a cylindrical side wall (sometimes outwardly and upwardly tapered in the case of food cans) and an integral bottom wall closing one end of the can. Usually, the beverage can body has a necked inward throat at its top which terminates in an outwardly extending body curl. An end for the can is provided with an end curl which is designed to interact with the body curl in seaming apparatus to attach the end to the can body after filling of the can to provide the requisite hermetic seal.

Both the can bodies and the can ends are formed from sheet or coil stock material. In view of the large quantities of cans and ends that are manufactured, it is economically very desirable to form the can bodies and ends from as thin a stock material as possible while retaining the necessary pressure-resistant strength therein. At the same time, it is also desirable to minimize the amount of waste of the stock material generated during the fabrication process.

A number of methods are known for fabricating the can bodies. In one method, known as the "draw and iron" method, a circular blank is formed from the stock material. The blank is then drawn in a ram press to form a cup-shaped receptacle having a bottom wall and a cylindrical wall. The cylindrical wall is of a diameter which is essentially the desired diameter for the finished can body, but is of a height which is substantially less than the desired final dimension. In addition, the thickness of the cylindrical wall is greater than that desired for the finished can body. The receptacle is then supported along its interior, and a hard metal ring having an inside diameter equal to the desired diameter of the completed can body is passed over the outside of the receptacle from the bottom wall along the cylindrical wall. This portion of the method, known as ironing, thins and stretches the metal of the cylindrical wall in the axial direction, thereby increasing the height of the receptacle. Upon the completion of ironing, the cylindrical wall is of the desired thickness and is of a height greater than the desired height for the finished can body.

In a second method, known as the "draw and redraw" method, a blank is formed into a cup-shaped receptacle, much as is done in the draw and iron method. However, the receptacle is formed having a diameter for the cylindrical wall that is somewhat greater than the desired diameter for the finished can body. The receptacle is then placed into tooling having a draw ring of the desired final diameter, and is drawn over the ring to reform the receptacle to the desired diameter, which also thins the cylindrical wall to the final desired thickness. The thinning and drawing lengthens the cylindrical wall in the axial direction to a length slightly greater than that desired for the completed can body. More than one redraw may take place.

Using either method, or combinations of those methods, further steps may be required or desirable, for example, providing a buckle-resistant shape to the bottom wall of the can body such as a central concave depression, or providing an inward necking of the upper end of the can body. In addition, it will be necessary to provide the body curl required for subsequent seaming of the body to the can end.

Can bodies formed by the methods described above are subject to a condition at the upper edge of the cylindrical wall which is known in the art as "earring". As the blank of metal is drawn into the cup-shaped receptacle and particularly as the receptacle is ironed or redrawn into the finished can body, considerable stretching of the metal stock occurs. However, this stretching is not entirely uniform throughout the blank, since the metal tends to stretch slightly more with the grain of the metal than across the grain. The result of such uneven "growth" of the metal is an uneven upper edge for the finished can body.

A can body exhibiting such earring is not desirable for seaming to the can end since the metal of the body curl may not tuck completely into the end curl on the can end at certain points along the can edge. In such a case, a complete seal may not be formed. Alternatively, certain portions of the body curl may tuck too far into the end curl, thereby distorting or even puncturing the material of the can end as seaming is completed.

To avoid these problems, it is necessary to carry out the additional step of trimming the upper end of the can body prior to formation of the body curl to provide a uniform upper edge. This eliminates the unevenness or earring, thereby ensuring proper sealing of the can end. However, the trimming operation results in waste of the can material. When multiplied by the very large number of cans that are manufactured, the amount of such material that is lost becomes substantial.

It is probably not possible to eliminate earring entirely, since some earring may result from local inconsistencies in the metal of specific blanks. However, if the degree of earring could be reduced, the amount of material which must be trimmed for each can body could then be decreased. In view of the large amount of material lost through the trimming operation, such savings would be significant.

What is needed, therefore, is a method and apparatus for forming can bodies which minimizes the amount of earring present on the finished bodies. Of course, to avoid creating other problems, such a method and apparatus should not result in any change in the dimensions of the finished can bodies, nor should such a method and apparatus require an increase in the amount of material required for each can body.

SUMMARY OF THE INVENTION

The present invention provides a method and apparatus whereby the aforementioned earring problem is significantly minimized, as a result of which the amount of waste material produced during can body fabrication is reduced. This is accomplished by forming the can body from a blank which is multi-sided in configuration rather than circular. The shape of the blank is such that the diameter of the blank parallel to the grain of the strip of stock material from which it is formed is less than the diameter of the blank transverse to the grain direction. The largest diameters may be provided at 45° to the grain direction. The degree may vary depending upon the metal used. The transition of the side edges of the blank between the different diameters are rounded. This initial formation of the blank compensates for the differences in the stretching characteristics of the metal with respect to the grain, and results in a final can body with significantly reduced earring. As a result, less material is lost through trimming of the can body.

The method of the present invention for fabricating a cylindrical can body includes, then, forming a rounded non-circular blank from a sheet of ductile metal, the blank having a greater width across the grain of the metal than along the grain. The blank is formed into a cup-shaped receptacle having a bottom wall and a cylindrical side wall of not less than the desired inside diameter of the can body. The cylindrical wall has an axial dimension substantially less than the desired axial dimension of the can body with the cylindrical wall of the receptacle being substantially thicker than the thickness desired in the finished can body. The cylindrical wall is then thinned to the desired thickness of the can body so as to lengthen the cylindrical wall in the axial direction to slightly greater than the desired axial dimension of the can body. The cylindrical wall is trimmed to the desired axial dimension of the can body.

According to one embodiment of the method, the cup-shaped receptacle is formed having the cylindrical wall of a diameter greater than the desired diameter for the finished can body. In such a case, the thinning of the cylindrical wall is performed by gripping the bottom wall of the receptacle and drawing the cylindrical wall over a cylindrical die by relative movement of the bottom wall with respect to the die. The thinning of the cylindrical wall is thus accomplished and, at the same time, the diameter of the cylindrical wall is reduced to the desired diameter for the can body.

In an alternative embodiment, the receptacle is formed having the cylindrical wall of a diameter of the desired diameter for the finished can body. Thinning of the cylindrical wall is then performed by supporting the receptacle on a mandrel having a cross section corresponding to the desired internal configuration of the can body. A hard ring of an inside diameter exceeding the outside diameter of the mandrel by substantially the desired thickness for the can body is provided. The ring is advanced over the cylindrical wall of the supported receptacle, whereby the thinning and lengthening of the cylindrical wall is accomplished.

The present invention also provides appropriate apparatus for carrying out the methods described above.

Accordingly, it is an object of the present invention to provide a method and apparatus for fabricating a cylindrical can body from a sheet of stock material that maximizes the use of stock material and reduces the amount of waste produced during such fabrication; to provide such a method and apparatus that reduces the amount of waste material by minimizing earring along the upper edge of the finished can body; to provide such a method and apparatus in which earring is reduced by accounting for variation in stretching characteristics of the stock material with respect to grain direction in the metal; and to provide such a method and apparatus which achieves the foregoing objects without requiring changes in the typical dimensions of the finished can body.

Other objects and advantages of the present invention will be apparent from the following description, the accompanying drawings and the appended claims.

DETAILED DESCRIPTION OF THE PREFERRED EMBODIMENTS

As noted above, the invention relates to a wide variety of unit body cans formed from various ductile metals, and it is understood that the embodiments illustrated and described, and any accompanying dimensions, are exemplary only and are not intended to limit the scope of the invention to any particular type of can body or any specific type of metal from which the can body is manufactured. Such can bodies generally comprise a bottom wall and an integral side wall of generally cylindrical configuration, which, it should be noted, may be of some form other than a right cylinder, such as a conic section. For purposes of this application and description, side walls formed as a conic section are to be considered as within the scope of the term "cylindrical."

Figure 1:
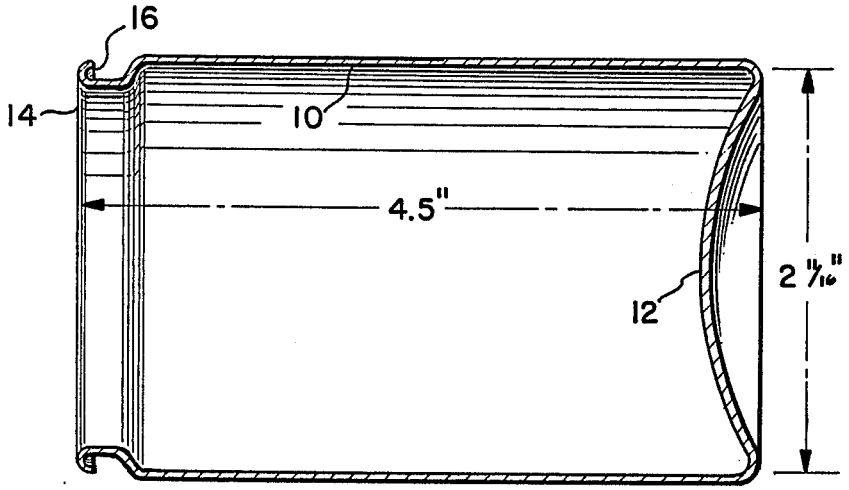
FIG. 1 is a sectional view of a typical beer/beverage can body such as is formed by the methods of the present invention.

Accordingly, FIG. 1 shows a typical configuration of a beverage can body that is the end result of the method of the present invention. The body includes a cylindrical side wall 10 and an integral end wall 12. End wall 12 may include a concave panel, as shown, or some other appropriate configuration to increase buckle strength. Cylindrical wall 10 is provided with a necked portion 14 near the upper edge 16 of the can body to permit the body to be closed by a can end of reduced diameter, such a configuration strengthening the body near its open end to permit the central portion of cylindrical wall 10 to be reduced in thickness. In a 12 ounce (354 ml) size, an aluminum can body may have a diameter of 211/16" and a height of 4½". Typical wall thicknesses include 0.012" for bottom wall 12 and 0.0045" for most of cylindrical wall 10. Near the bottom end of cylindrical wall 10, however, the thickness may be near 0.012", while along necked portion 14 the thickness may be 0.009".

The fabricating of a can body such as that shown in FIG. 1 in accordance with the present invention involves a series of operations, most of which can be carried out within one or more conventional ram presses having specially adapted toolings.

The can bodies are fabricated from relatively thin metal stock having a typical thickness of 0.02". While the stock material is typically aluminum, steel or other ductile metals may also be used.

Initially, a blank is produced from the stock material, which is then worked to form the can body. Because of the depth of the finished can, it is generally not practical to extrude the completed body as a single draw, and a cup-shaped receptacle is initially produced. The receptacle is then worked to produce the completed body.

Figure 2:
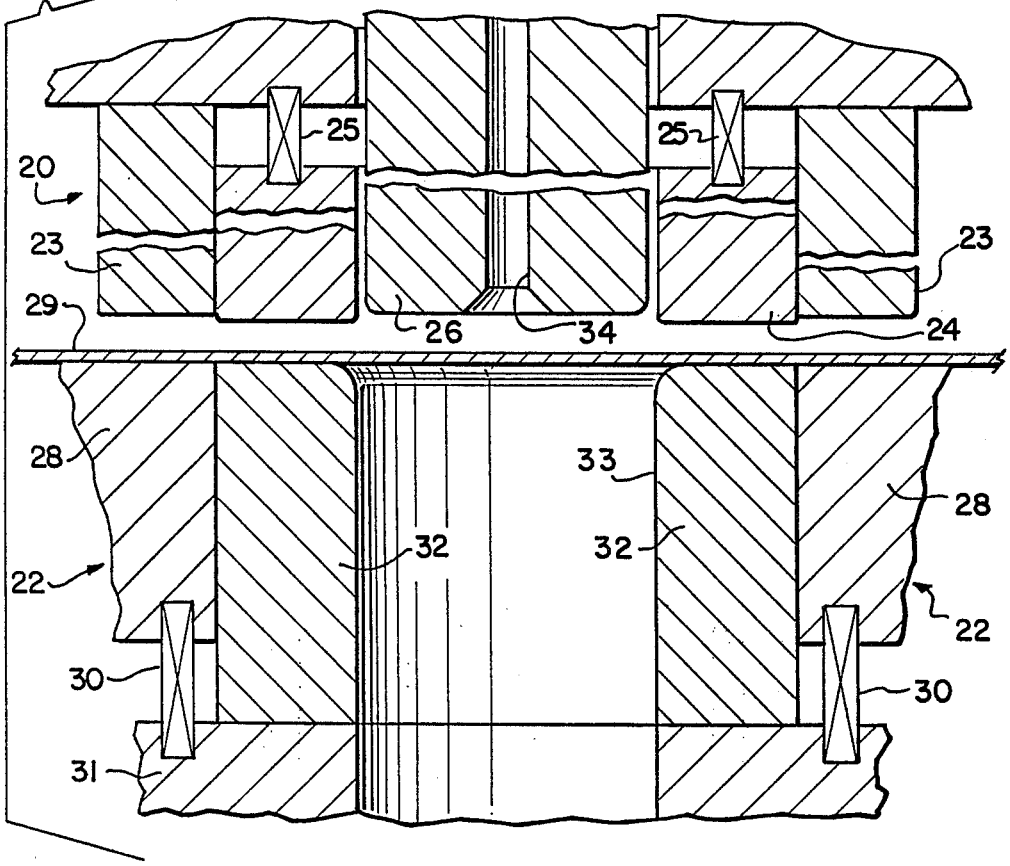
FIG. 2 is a sectional view of tooling for forming a blank and producing an intermediate receptacle.

An example of appropriate tooling for blanking and forming of the intermediate receptacle is shown in FIG. 2. The illustrated tooling is constructed for use within a double-acting press, i.e., a press having an inner slide and an outer slide, the outer slide having a shorter stroke than the inner. An upper tooling 20 is connected for operation by the press ram, while the lower tooling 22 is fixed to the press frame.

Upper tooling 20 includes a blank die 23, solidly connected to the outer slide for reciprocal action. A pressure pad 24 is connected to the outer slide through air springs 25, and leads blank die 23 by a slight distance when the press ram is raised. A center draw punch 26 is mounted inside pressure pad 24, but is connected for operation by the inner slide. Both blank die 23 and pressure pad 24 lead draw punch 26 when the tooling is raised.

Lower tooling 22 includes a stripper or stock plate 28, over which metal stock 29 passes as it enters the tooling. Stripper 28 is supported by air springs 30 from a suitable base member 31. Mounted inside stripper 28 is a combination blank punch/draw die 32, mounted solidly to base member 31. Blank punch/draw die 32 includes a central opening 33 extending through the lower tooling 22.

Figure 3:
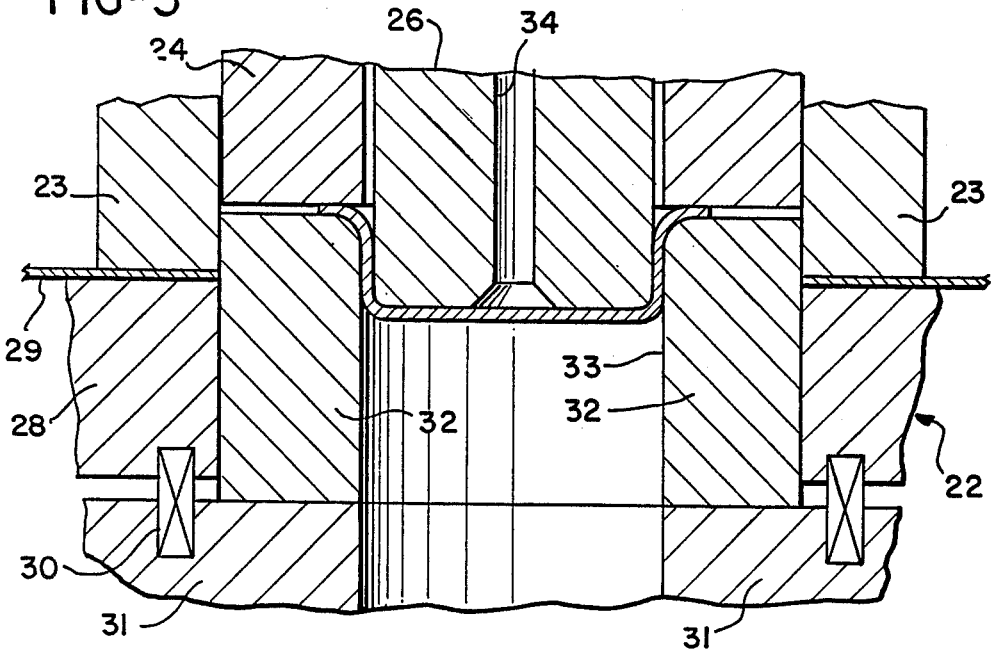
FIG. 3 is a view of the tooling of FIG. 2, showing production of the intermediate receptacle.

Referring now to FIG. 3, lowering of the press ram first causes pressure pad 24 to contact metal stock 29. Pressure pad 24 halts its downward movement, with further lowering of the press ram causing the springs supporting pressure pad 24 to collapse, thereby exerting a clamping force upon the metal stock. The inner edge of blank die 23 and the outer edge blank punch/draw die 32 next cooperate as the ram is lowered to shear a flat blank from the stock material. Continued movement of the ram results in downward movement of both the stock skeleton and stripper 28 beneath blank die 23.

Continued lowering of the press ram causes draw punch 26 to move against the clamped blank, thereby causing the blank to be drawn across the curved inner edge of blank punch/draw die 32 so that formation of the intermediate receptacle begins. Draw punch 26 is moved downwardly into opening 33 until the blank is drawn completely from between pressure pad 24 and blank punch/draw die 32, whereupon the receptacle is completely formed.

The completed receptacle is then removed from draw punch 26 which may be accomplished, for example, by moving draw punch 26 with the press ram to a point below lower tooling 22, where a stripping device may be positioned. In addition, punch die 26 is provided with a central passageway 34 through which compressed air may be supplied to facilitate removal of the receptacle from the punch.

In known methods of can body formation, the preceding operation produces a receptacle that exhibits some degree of earring. As the receptacle is worked into the finished can body, using procedures such as will be described below, the degree of earring is increased so a significant amount of material is lost through trimming of the finished can body.

Figure 4:
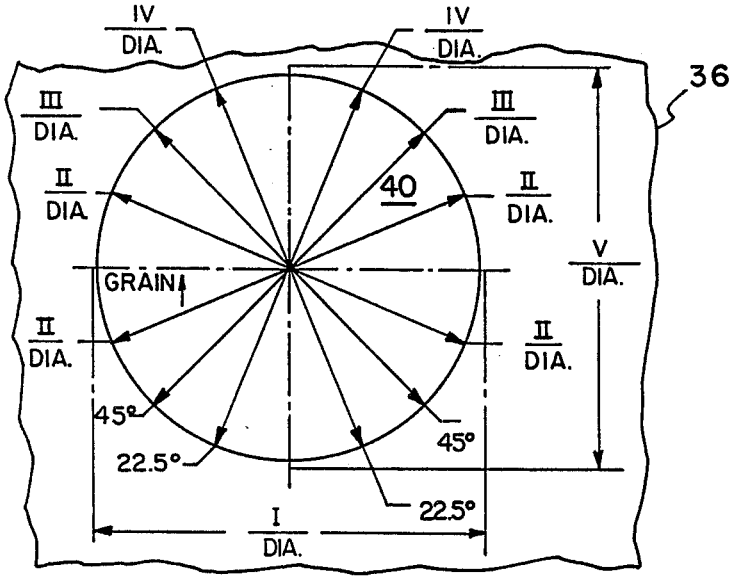
FIG. 4 is a plan view of a blank formed in accordance with the present invention.

Earring is minimized in the present invention by the manner in which the blank is cut from the stock material. Referring to FIG. 4, a portion of the strip of stock material from which the blanks are cut is shown at 36, and the shape of the blank is indicated within the area designated 40, which as will be described, is a multi-sided form with rounded transitions from one side to the next, rather than an accurate circle of the same diameter throughout.

It has been discovered that the earring effect or distortion can be greatly minimized if the shape of the blank 40 is properly selected with respect to the grain of the material, which is indicated by an arrow and appropriate legend in FIG. 4. Thin sheet metal material, for example aluminum and steel, tends to grow or stretch more in the direction of the grain, and even more in a direction at 45° to the grain, than across the grain. These principles are applied in designing the shape of the blank in accordance with the present invention.

The diameter of the blank 40 along its horizontal axis (as shown in FIG. 4), diameter I—I is the largest, since it is in this direction that the blank least tends to grow as it is worked in forming the intermediate receptacle and the finished can body. The vertical diameter V—V of the blank, on the other hand, is smaller, while the diameters III—III at 45° in each direction from the vertical diameter is smallest. It has been found that it is in this direction with respect to the grain that the blank most tends to grow.

Such a blank is referred to as a "multiple point" blank in reference to the points of intersection of the specified diameters used in designing the blank with the blank's periphery. The specific blank 40 illustrated in FIG. 4 can be referred to as a "16 point" blank, due to the eight different specified diameters. In actual practice, the number of different diameters, their relative angular positions and size relationships may vary with the finished product size and the specific stock material. It is anticipated that a 16 point blank will be fairly typical, although an 8 point, 12 point, 24 point, or even 32 point blank may well be practical.

It will be noted from FIG. 4 that, despite the non-circular nature of blank 40, the blank will nonetheless appear to be substantially circular. This is because the difference between the longest and shortest of the predetermined diameters used in designing the blank is quite small, typically in the order of less than 1%. However, because of the extensive thinning of the blank material during can formation, such seemingly small differences will be sufficient to minimize earring in the completed can body. Of course, the actual relative difference between predetermined diameters in a blank designed for a practical embodient of the present invention is not restrictive as to the scope of the invention.

Returning now to the intermediate formed by the initial drawing portion of the fabrication method, the dimensions of the ultimate receptacle will be determined in part by the remaining steps selected for the method. In any case, a typical beverage can will be formed having a wall thickness of approximately 0.0125". If formation is to be completed using a draw and redraw method, the can body will have an inside diameter of 3¾" and the cylindrical wall will be 1¾" in the axial direction. However, if formation is to be completed using a draw and iron method, the can body will be formed having an inside diameter 211/16", which is the desired diameter for the finished can body. In such a case, the body will have a height of 2¾".

Figure 5:
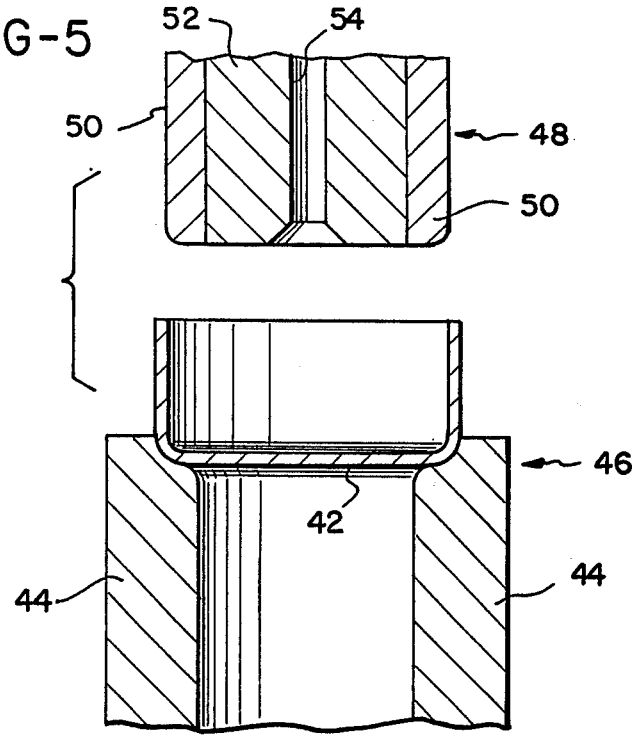
FIG. 5 is a sectional view of tooling for working the receptacle into a finished can body using a redraw process.
Figure 6:
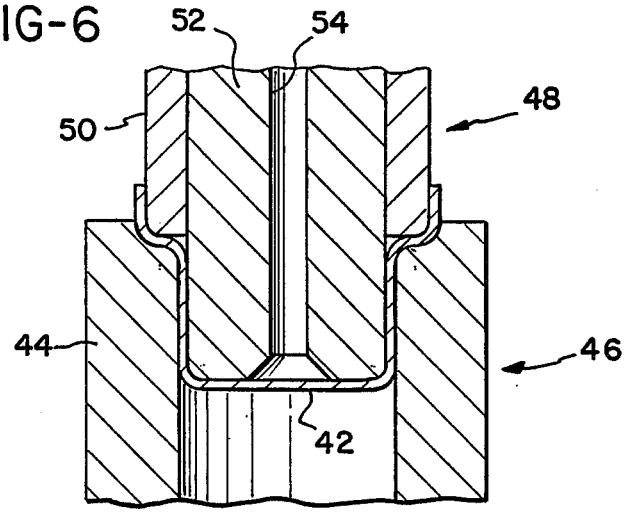
FIG. 6 is a view of the tooling of FIG. 5, showing redrawing of the receptacle.

Completion of the can body by the draw and redraw method can be seen by reference to FIGS. 5 and 6. Referring to FIG. 5, the receptacle 42 enters the redraw tooling and is positioned within redraw ring 44 which comprises lower tooling 46. Upper tooling 48 includes a pressure ring 50 and punch center 52.

Referring to FIG. 6, as the press ram is lowered, pressure ring 50 contacts receptacle 42 at the portion thereof supported by redraw ring 44. Further movement of pressure ring 50 is prevented, such as by connecting ring 50 to the press ram through springs (not shown). Further lowering of the press ram causes punch center 52 to contact the bottom wall of receptacle 42, moving it downwardly through the center of redraw ring 44. This movement draws the remaining portion of receptacle 42 over redraw ring 44, thereby thinning and lengthening the cylindrical wall into the desired configuration for the finished can body. Once the cylindrical wall has been drawn completely from between redrawn ring 44 and pressure ring 50, formation of the can body is completed.

The body may then be removed from center punch 52, such as by moving the punch beneath lower tooling 46, where an appropriate stripping mechanism (not shown) may be used to pull the can body from punch 52 as the press ram is raised. In addition, a central passageway 54 is provided through center punch 52, so that compressed air may be used to facilitate removal of the finished can body.

Figure 7:
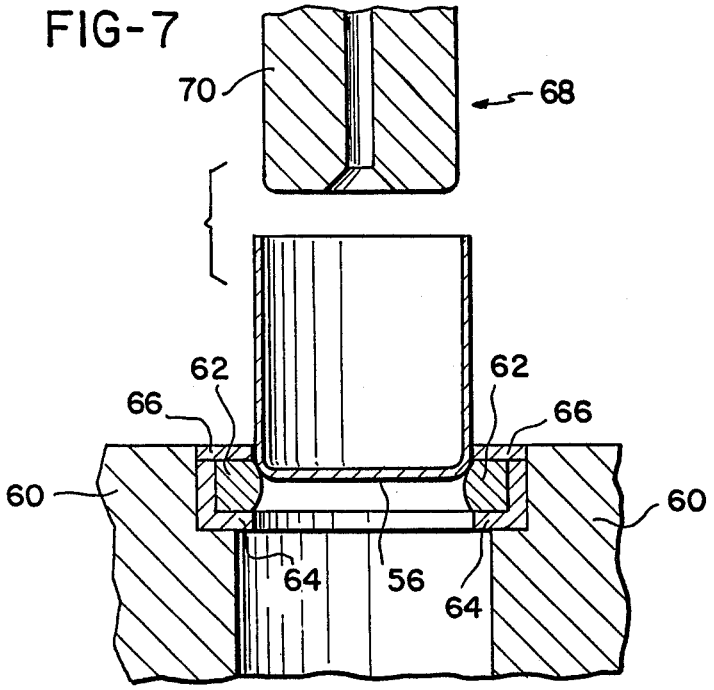
FIG. 7 is a sectional view of tooling for working the receptacle into a finished can body using an ironing process.
Figure 8:
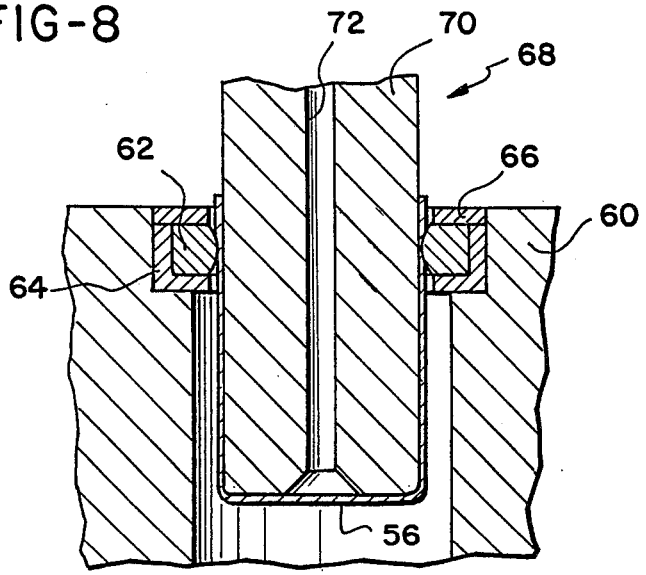
FIG. 8 is a view of the tooling of FIG. 7, showing ironing of the receptacle.

Completion of the can body using the draw and iron method can be seen by reference to FIGS. 7 and 8. The intermediate receptacle 56 is placed within tooling having a lower tooling 58 including a support ring 60. Support ring 60 includes a central opening, about which a recess is formed into ring 60. An ironing ring 62, which is formed from a hard material such as tungsten carbide, is supported by a holder ring 64 and secured by a retaining ring 66. Ironing ring 62 protrudes into the central opening within support ring 60, and has an inside diameter that is equal to the desired inside diameter for the can body plus the desired thickness for the cylindrical wall thereof.

Upper tooling 68 includes a cylindrical ironing mandrel 70 that has a diameter equal to the desired inside diameter of the finished can body. Mandrel 70 is connected to the press ram, so that as seen in FIG. 8, lowering of the press ram causes mandrel 70 to engage receptacle 56. Further lowering of the press ram forces receptacle 56 through ironing ring 62, which thins the cylindrical wall of the receptacle and as a result lengthens the cylindrical wall to the desired height for the finished can body. After complete passage through ironing ring 62, the finished body is removed from mandrel 70, and a central compressed air passage 72 is provided through mandrel 70 to facilitate such removal.

In connection with the draw and iron method of fabricating can bodies, it should be noted that it is entirely practical to both draw and iron the blank to form the completed body within a single set of tooling. In such a case, the ironing ring is mounted beneath the draw ring, so that lowering of the upper tooling not only draws the blank into the intermediate receptacle, but also forces the receptacle through the ironing ring to produce the finished body. An example of such tooling may be seen in U.S. Pat. No. 4,040,282 issued Aug. 9, 1977 to Saunders, which is hereby incorporated by reference.

Regardless of which of the two methods described above by which the can body is fabricated, it will normally be desired to form a concave recess or other reinforcing structure into the bottom wall of the can body. An example of such a configuration is shown in FIG. 1. Such reinforcement may be provided after completion of the draw and iron or draw and redraw procedures, and the appropriate tooling may be incorporated into that shown for the ironing and redraw portions of the formation method. An example of appropriate tooling for providing such reinforcement is disclosed in U.S. Pat. No. 3,998,174 issued Dec. 21, 1976 to Saunders, which is hereby incorporated by reference.

As an alternative, when the draw and iron method is used, the reinforcement configuration of the bottom wall may be formed into the intermediate receptacle prior to the ironing operation. An example of tooling through which this may be accomplished is disclosed in U.S. Pat. No. 3,593,552 issued July 20, 1971 to Fraze, which is hereby incorporated by reference.

U.S. Pat. No. 3,593,552 further discloses that variations in the thickness of the cylindrical wall of the finished can body can be achieved by using an ironing mandrel whose diameter varies slightly to produce the variation in wall thickness. Since it is normally desirable to provide a greater thickness for the cylindrical wall near the bottom panel and the upper open end, it is anticipated that the techniques disclosed in the Fraze reference for achieving such thickness variations will be incorporated into the methods of the present invention described herein.

Following formation of the can body, it will be necessary to trim the upper edge of the cylindrical wall to ensure that this edge is uniform. This is required since earring along this upper edge can interfere with later seaming of the can body to the can end for closure of the can. While the method of the present invention reduces very substantially the amount of earring present along the upper edge, it will nonetheless be desirable to trim the can body. This is because it is probably not possible to completely eliminate earring, as some minimal earring may result from local variations in the metal from which specific blanks are formed. Further, some trimming will ensure uniform height for all can bodies.

The trimming operation can be carried out by any appropriate apparatus, and may for example be performed while the finished can body is still in place upon center punch 52 following the redraw operation, or upon mandrel 70 following ironing. Appropriate trimming apparatus is well known within the art.

Use of the present invention, will result in the production of a can body in which the amount of material to be trimmed will be reduced. While the specific reduction per can may not be quantitatively large, it must be kept in mind that very large numbers of can bodies are produced each year. Thus, the methods of the present invention can provide a savings of thousands of pounds of stock material or more per year. Of course, this represents a significant and substantial advantage.

After the trimming operation, it will be necessary to add the necked portion and body curl to the upper end of the can body. This can be performed by any known method, with one example of an appropriate apparatus being disclosed in U.S. Pat. No. 4,446,714, issued May 8, 1984 to Cvacho.

While the methods herein described, and the form of apparatus for carrying these methods into effect, constitute preferred embodiments of this invention, it is to be understood that the invention is not limited to these precise methods and forms of apparatus, and that changes may be made in either without departing from the scope of the invention, which is defined in the appended claims.

What is claimed is:

1. A method of fabricating from ductile sheet metal a can body with an integral bottom wall, comprising the steps of:

forming a rounded non-circular blank having an outer edge from a sheet of ductile metal, said outer edge being continuously rounded, said blank having a greater width across the grain of the metal than along such grain;

forming said blank into a cup-shaped receptacle having a bottom wall and a side wall of not less than the desired inside diameter of the can body, said side wall having an axial dimension substantially less than the desired axial dimension of the can body with the side wall of said receptacle substantially thicker than the thickness desired in the finished can body; and thinning the side wall of said receptacle to the desired thickness of the can body so as to lengthen the side wall in the axial direction to at least the desired axial dimension of the can body.

2. The method as defined in claim 1 further comprising the step of trimming the side wall to the desired axial dimension of the can body.

3. The method as defined in claim 1, wherein:

said receptacle is formed having a cylindrical side wall of a diameter greater than the desired diameter for the can body; and said thinning of the side is performed by gripping said bottom wall of said receptacle and drawing said side wall over a cylindrical die by relative movement of said bottom wall with respect to said die, whereby said thinning is accomplished and the diameter of said cylindrical wall is reduced to the desired diameter for the can body.

4. The method as defined in claim 1, wherein:

said receptacle is formed having said cylindrical wall of a diameter of substantially the desired diameter for the can body; and said thinning of said cyindrical wall is performed by supporting said receptacle on a mandrel having a cross section corresponding to the desired internal configuration of the can body, providing a hard ring of an inside diameter exceeding the outside diameter of said mandrel by substantially twice the desired thickness for the can body, and advancing said ring over said cylindrical wall of said receptacle supported upon said mandrel in a direction from said bottom wall, whereby said thinning is accomplished.

5. The method as defined in claim 1, wherein the blank is formed from the sheet of metal to a shape having a smaller width at angles other than either across or along such grain.

6. The method as defined in claim 5, wherein the blank is formed as a multiple point blank.

7. A method of fabricating from ductile sheet metal a generally cylindrical can body with an integral bottom wall, comprising the steps of:

forming a rounded non-circular blank having an outer edge from a sheet of ductile metal, said outer edge being continuously rounded, the shape of said blank being defined by a first diameter and at least one additional diameter angularly spaced from said first diameter, said first diameter being aligned with the grain of the metal and being of a length less than said additional diameter;

forming said blank into a cup-shaped receptacle having a bottom wall and a side wall of not less than the desired inside diameter of the can body, said side wall having an axial dimension substantially less than the desired axial dimension of the can body with the side wall of said receptacle substantially thicker than the thickness desired in the finished can body; and thinning the side wall of said receptacle to the desired thickness of the can body so as to lengthen the cylindrical wall in the axial direction to at least the desired axial dimension of the can body.

8. The method as defined in claim 7, wherein:

said receptacle is formed having said side wall of a diameter greater than the desired diameter for the can body; and said thinning of said side wall is performed by gripping said bottom wall of said receptacle and drawing said wall over a cylindrical die by relative movement of said bottom wall with respect to said die, whereby said thinning is accomplished and the diameter of said cylindrical wall is reduced to the desired diameter for the can body.

9. The method as defined in claim 7, wherein:

said receptacle is formed having a cylindrical wall of a diameter of substantially the desired diameter for the can body; and said thinning of said cyindrical wall is performed by supporting said receptacle on a mandrel having a cross section corresponding to the desired internal configuration of the can body, providing a hard ring of an inside diameter exceeding the outside diameter of said mandrel by substantially twice the desired thickness for the can body, and advancing said ring over said cylindrical wall of said receptacle supported upon said mandrel in a direction from said bottom wall, whereby said thinning is accomplished.

10. Apparatus for fabricating from ductile sheet metal a can body with integral side and bottom walls, comprising:

means for forming a rounded non-circular blank having an outer edge from a sheet of ductile metal, with said outer edge being continuously rounded and said blank having a greater width across the grain of the metal than along such grain;

means for forming said blank into a cup-shaped receptacle having a bottom wall and a side wall of not less than the desired internal size of the can body, said side wall having a length substantially less than the desired depth of the can body with the side wall of said receptacle substantially thicker than the thickness desired in the finished can body; and means for thinning the side wall of said receptacle to the desired thickness of the can body so as to lengthen the side wall to at least the desired depth of the can body.

11. Apparatus as defined in claim 10, wherein:

said receptacle forming means forms said receptacle to include a cylindrical wall of a diameter greater than the desired diameter for the can body; and said thinning means includes a cylindrical die, means for gripping said bottom wall of said receptacle, and means for drawing said cylindrical wall over said cylindrical die by relative movement of said bottom wall with respect to said die, whereby said thinning is accomplished and the diameter of said cylindrical wall is reduced to the desired diameter for the can body.

12. Apparatus as defined in claim 10, wherein:

said receptacle forming means forms said receptacle having a cylindrical wall of substantially the desired size for the can body; and said thinning means includes a mandrel for supporting said receptacle having a cross section corresponding to the desired internal configuration of the can body, a hard ring of an inside diameter exceeding the outside diameter of said mandrel by substantially twice the desired thickness for the can body, and means for advancing said ring over said cylindrical wall of said receptacle supported upon said mandrel in a direction from said bottom wall, whereby said thinning is accomplished.

13. Apparatus as defined in claim 10, wherein said blank forming means forms said blank from said sheet of metal having a smaller width at angles other than either across or along such grain.

14. Apparatus for fabricating from ductile sheet metal a can body with integral side and bottom walls, comprising:

means for forming a rounded non-circular blank having an outer edge from a sheet of ductile metal, with said outer edge being continuously rounded and the shape of said blank being defined by a first diameter and at least one additional diameter angularly spaced from said first diameter, said first diameter being aligned with the grain of the metal and being of a length less than said additional diameter;

means for forming said blank into a cup-shaped receptacle having a bottom wall and a side wall of not less than the desired internal size of the can body, said side wall having a length substantially less than the desired depth of the can body with the side wall of said receptacle substantially thicker than the thickness desired in the finished can body; and means for thinning the side wall of said receptacle to the desired thickness of the can body so as to lengthen the side wall in the axial direction to at least the desired depth of the can body.

15. The method as defined in claim 1, wherein the difference between the smallest and the greatest widths of said blank is in the order of less than 1%.

16. The method as defined in claim 7, wherein the difference between the smallest and the greatest widths of said blank is in the order of less than 1%.

* * * * *